US005896919A

United States Patent [19]

Ho

[11] Patent Number: 5,896,919

[45] Date of Patent: Apr. 27, 1999

[54] PLASTIC PARTICLES COOLING DEVICE

[76] Inventor: Mark Ho, No. 6-13, Chong Chi Road, Sa Lu Town, Taichung Hsien, Taiwan

[21] Appl. No.: 09/131,934

[22] Filed: Aug. 10, 1998

[51] Int. Cl.[6] ..... F28B 9/10

[52] U.S. Cl. ..... 165/111; 165/119; 165/157; 62/63; 62/64

[58] Field of Search ..... 165/110, 111, 165/119, 157, 112; 134/182, 133; 366/183.2, 165.2, 165.1; 62/64, 63

[56] References Cited

U.S. PATENT DOCUMENTS

| | | | |
|---|---|---|---|
| 1,931,988 | 10/1933 | Hromadka | 165/119 |
| 2,630,918 | 3/1953 | Janows | 134/182 |
| 3,332,780 | 7/1967 | Smith, Jr. | 62/64 |
| 3,423,950 | 1/1969 | Reynolds | 62/64 |
| 3,768,272 | 10/1973 | Barrett | 62/64 X |
| 4,422,932 | 12/1983 | Kalberer | 165/119 X |
| 4,782,843 | 11/1988 | Lapaglia | 134/133 X |
| 5,438,840 | 8/1995 | Barber, III et al. | 62/64 |
| 5,706,884 | 1/1998 | Klaren | 165/119 X |

*Primary Examiner*—Ira S. Lazarus
*Assistant Examiner*—Christopher Atkinson

[57] ABSTRACT

A cooling device for cooling plastic particles includes a casing having a hub extended upward from an inner and lower portion for forming an annular chamber between the casing and the hub. A water is supplied into the annular chamber for moving the plastic particles upward and out through the hub, such that the plastic particles may be cooled by the water. A housing is secured on top of the casing and a pipe is coupled to the housing for supplying the plastic particles into the housing and for cooling the plastic particles in the housing by the air flowing into the housing.

10 Claims, 4 Drawing Sheets

PLASTIC PARTICLES COOLING DEVICE

BACKGROUND OF THE INVENTION

1. Field of the Invention

The present invention relates to a cooling device, and more particularly to a cooling device for cooling plastic particle materials.

2. Description of the Prior Art

Typical plastic particles, after produced by plastic particles manufacturing machines, are hot and should be cooled before they are supplied into the molding machines or the like. The plastic particles are typically cooled for a long time by circulating air and may not be quickly cooled down, such that the manufacturing speed is greatly decreased.

The present invention has arisen to mitigate and/or obviate the afore-described disadvantages of the conventional plastic particles cooling devices.

SUMMARY OF THE INVENTION

The primary objective of the present invention is to provide a plastic particle cooling device for quickly cooling the plastic particles.

In accordance with one aspect of the invention, there is provided a cooling device for cooling plastic particles, the cooling device comprising a casing including an inner and lower portion having a hub secured thereon for defining an annular chamber between the casing and the hub, the hub including an open upper portion and including an outlet, means for supplying a water into the annular chamber, the water being allowed to flow into the hub via the open upper portion of the hub and to flow out of the casing via the outlet of the hub, and means for supplying the plastic particles into the water received in the annular chamber, the plastic particles being moved upward along the annular chamber by the water and flown out of the hub for allowing the plastic particles to be cooled by the water.

The annular chamber includes a bottom portion, the water supplying means includes a duct secured to the casing and communicating with the bottom portion of the annular chamber for supplying the water into the annular chamber. The duct is tangent to the casing for generating a helical water flow and for allowing the water to flow upward of the annular chamber in a helical way.

The casing includes an upper portion, the coupling device further includes a housing secured on the upper portion of the casing, the plastic particles supplying means includes a pipe coupled to the housing for supplying the plastic particles into the housing, the housing includes a bottom portion having a mouth communicating with the annular chamber for allowing the plastic particles to flow into the annular chamber. The housing includes an upper portion having a screen secured thereon for preventing the plastic particles from flowing outward of the housing. The screen includes a center portion having a tube secured thereon for allowing air to quickly flow out of the housing. The housing includes a wavy peripheral wall for allowing the plastic particles to strike onto the wavy peripheral wall and for preventing the plastic particles from sticking together.

A shielding means is further provided for shielding the hub, the plastic particles being prevented from directly flowing into the hub by the shielding means. The shielding means includes a shield secured in the casing and secured above the hub for preventing the plastic particles from directly flowing into the hub.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
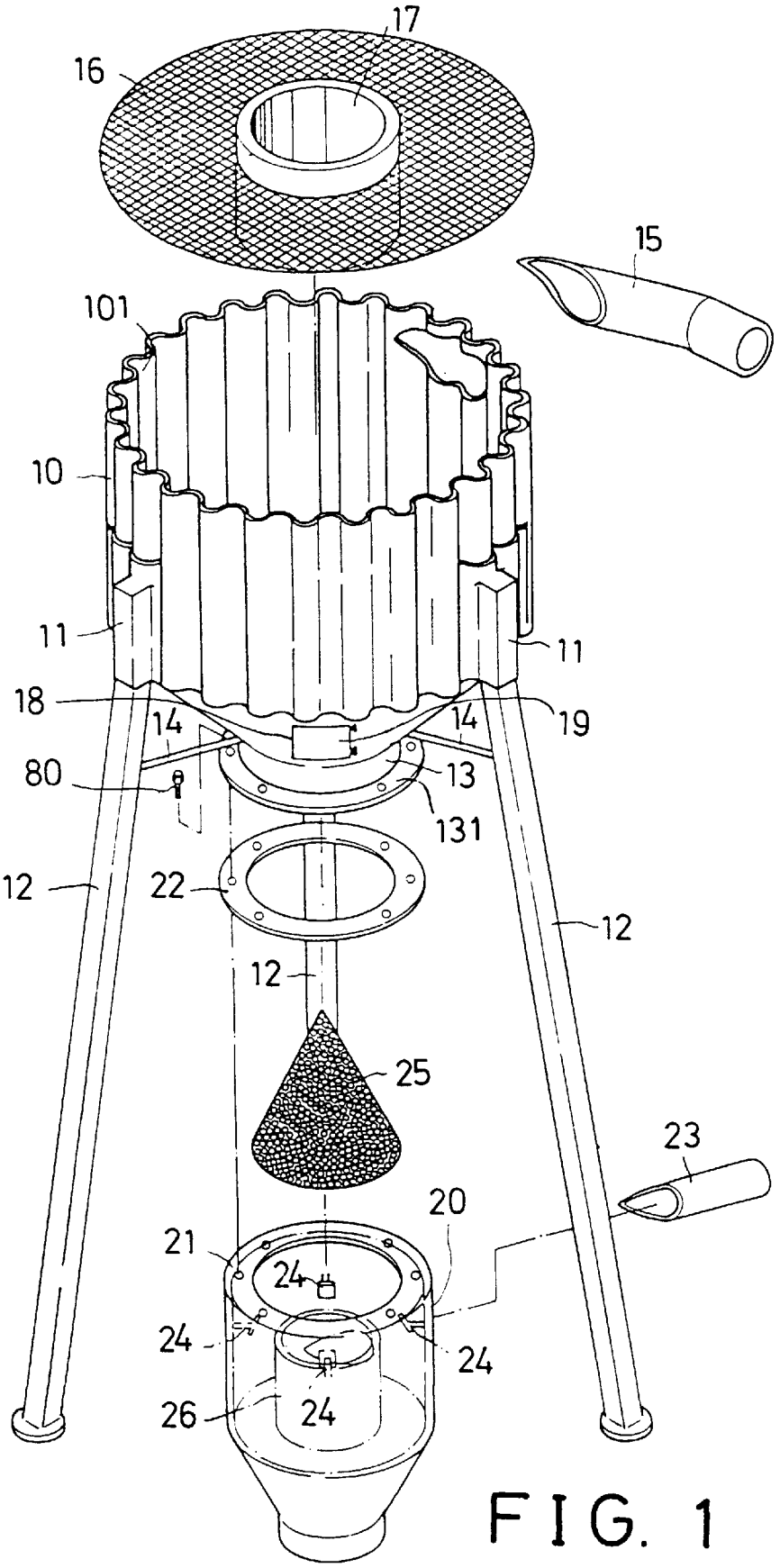
FIG. 1 is an exploded view of a plastic particle cooling device in accordance with the present invention.
Figure 2:
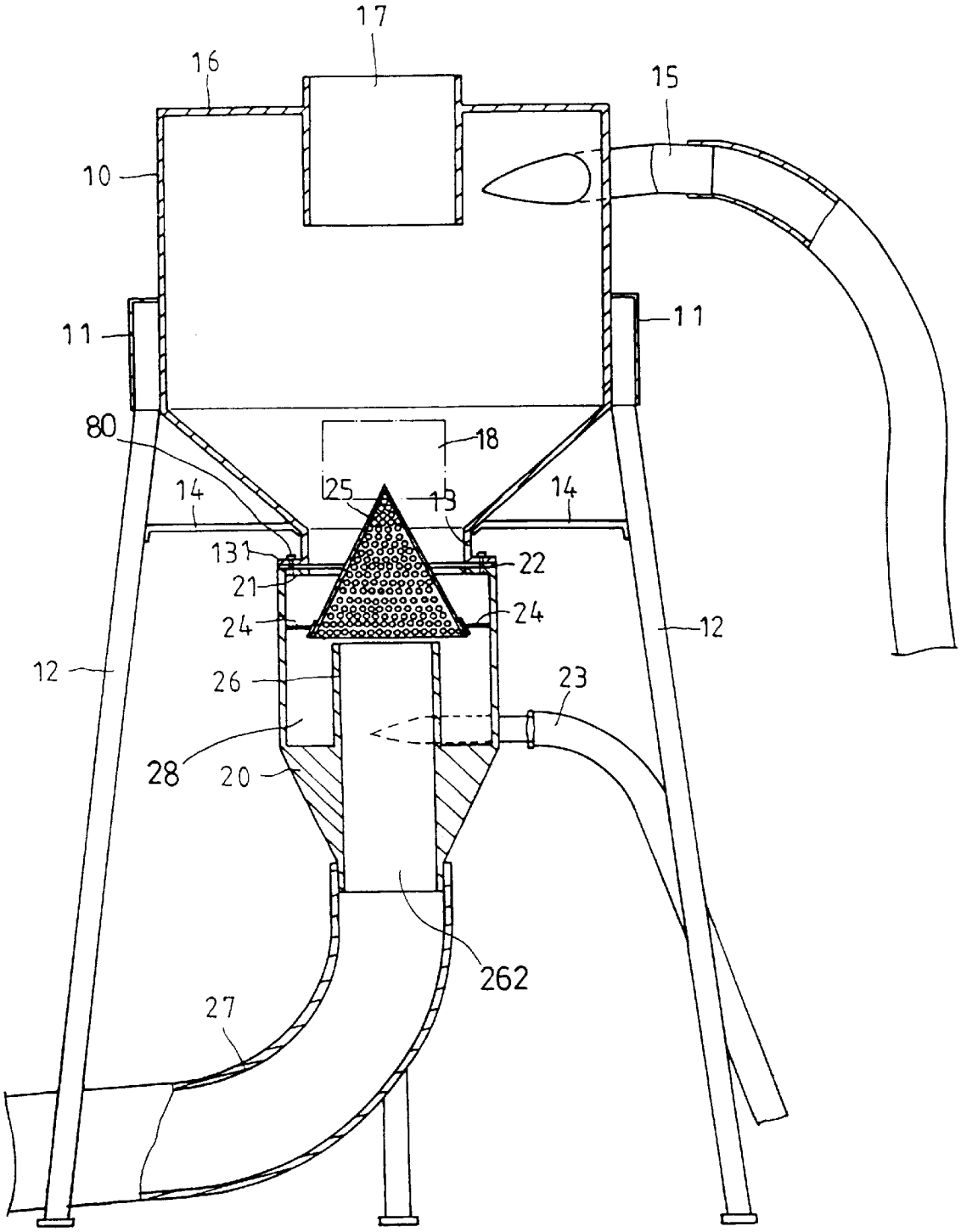
FIG. 2 is a cross sectional view taken along lines 2—2 of FIG. 4.
Figure 3:
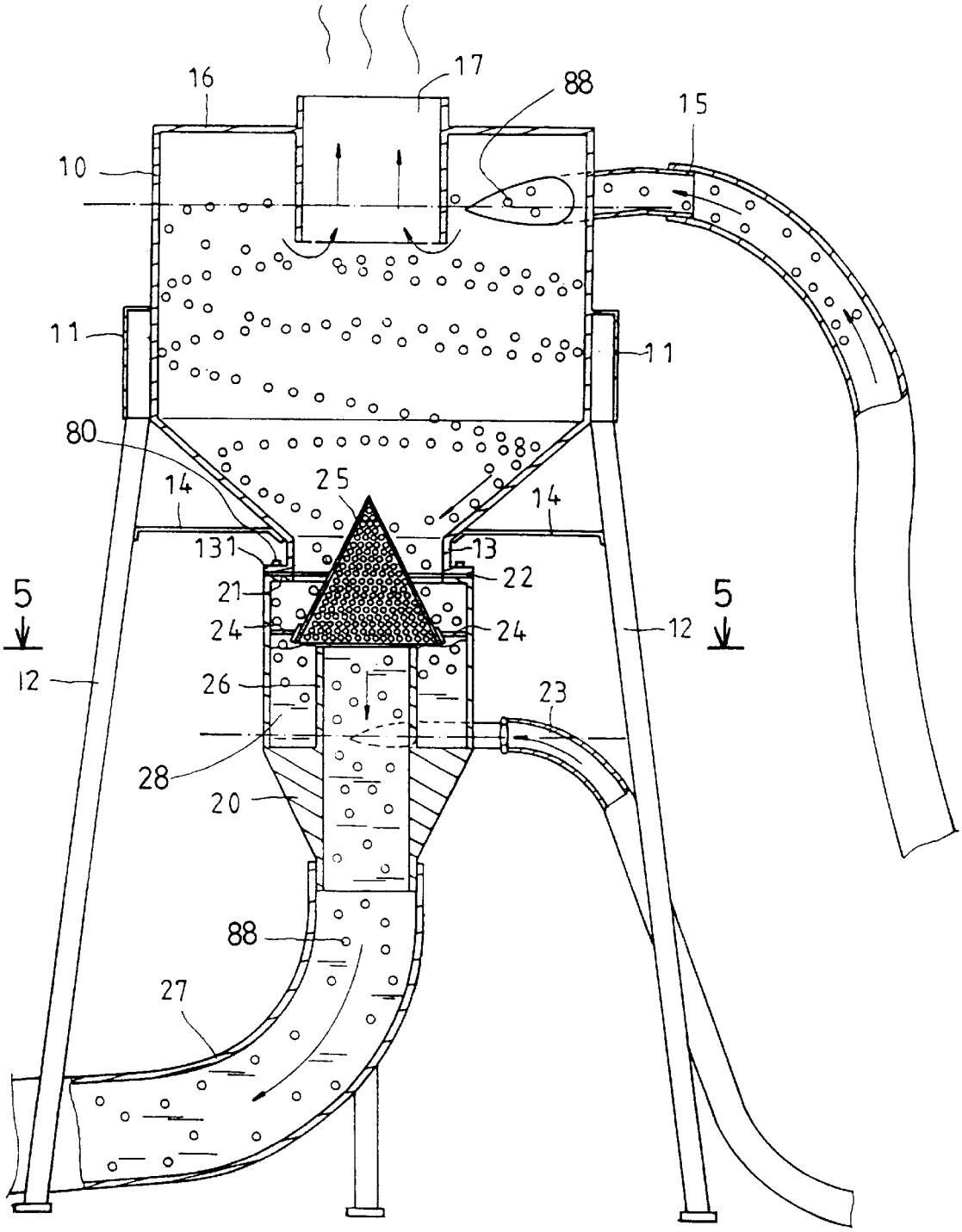
FIG. 3 is a cross sectional view similar to FIG. 2, illustrating the 'operation of the plastic particle cooling device.
Figure 4:
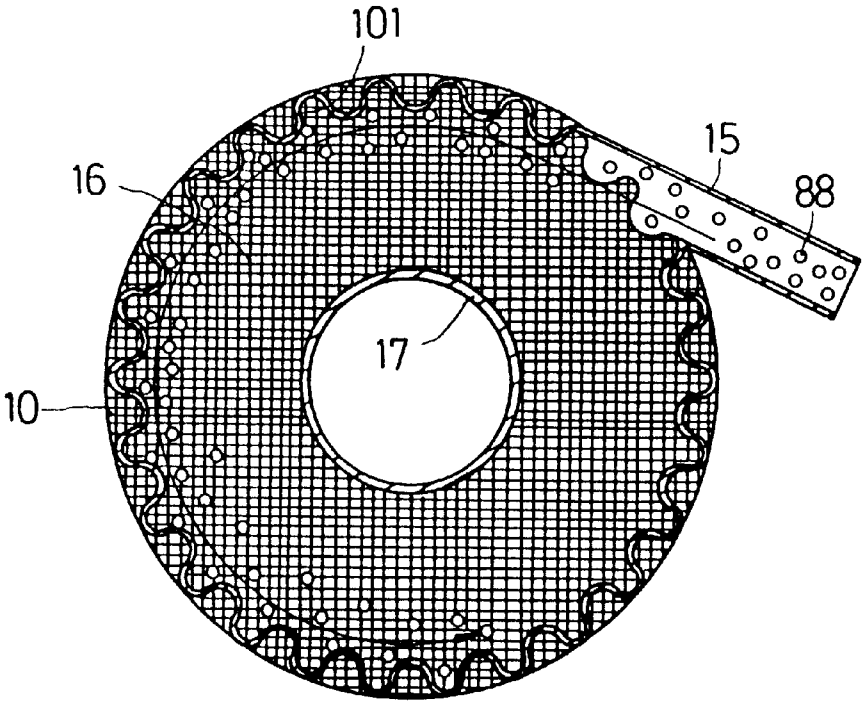
FIG. 4 is a top view of the plastic particle cooling device.

Referring to the drawings, and initially to FIGS. 1 and 2, a plastic particles cooling device in accordance with the present invention comprises a housing 10 including a wavy peripheral wall 101 having a mouth 13 formed in the bottom and having three or more couplers 11 for receiving the upper ends of three or more legs 12 which may support the housing 10 on ;,a supporting surface. Three or more bars 14 are secured between the mouth 13 of the housing 10 and the legs 12 for solidly securing the legs 12 to the housing 10. A screen 16 is secured on top of the housing 10 by such as welding processes and a tube 17 is secured in the middle portion of the screen 16 and communicating with the interior of the housing 10. A pipe 15 has one end secured to the upper portion of the housing 10 by such as welding processes and coupled to an air supplier and a plastic particles 88 supplier for supplying the air and the plastic particles 88 into the housing 10 (FIGS. 3, 4). The housing 10 includes an annular flange 131 extended radially outward from the bottom portion. The lower portion of the housing 10 includes an opening 18 and a cover 19 pivotally secured to the housing 10 for selectively blocking the opening 18 and for allowing the operator to clean the interior of the housing 10.

Figure 5:
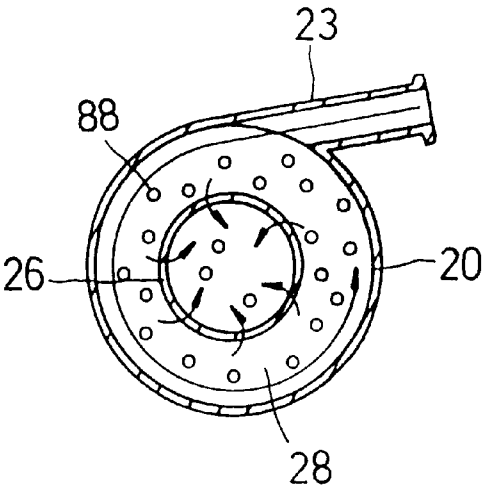
FIG. 5 is a cross sectional view taken along lines 5—5 of FIG. 3.

A casing 20 includes an annular flange 21 extended radially inward from the upper portion. A gasket or a washer 22 is disposed between the flanges 21, 131 which are secured together by fasteners 80. The casing 21 includes a hub 26 extended upward from the inner and center portion for defining an annular chamber 28 between the casing 20 and the hub 26. A duct 23 has one end secured to the casing 20 and has the other end coupled to a water reservoir for supplying the water into the annular chamber 28 (FIGS. 3, 5). It is preferable that the duct 23 is tangent to the casing 20 and supplies the water to the bottom portion of the annular chamber 28 and to generate a water flow which may flow upward along the annular chamber 28 in a helical way and which may move the water and the plastic particles 88 out of the casing 20 via the hub 26. A hose 27 is secured to the bottom of the casing 20 and coupled to the outlet 262 of the hub 26 for receiving the water from the hub 26 of the casing 20. A shield 25 of pyramid shape is secured in the casing 20 by three or more rods 24 and is disposed above the hub 26 for preventing the plastic particles 88 from directly dropping into the hub 26 and for allowing the plastic particles 88 to be suitably cooled by the water before flowing out of the casing 20.

The plastic particles 88 blown into the housing 10 have a suitable weight and may move gradually downward in a helical way and may be cooled by the air. The plastic particles 88 may also be caused to strike onto the wavy peripheral wall 101 which may separate the plastic particles 88 from each other and which may prevent the plastic particles 88 from sticking together. The tube 17 may prevent the plastic particles 88 from being blown out of the housing 10 and may allow the heat air to quickly flow out of the housing 10. The heat air may also flow out through the screen 16. The plastic particles 88 may then drop into the water received in the annular chamber 28 of the casing 20 and may be moved upward by the helical water flow and may flow outward through the open upper portion of the hub 26 and the hose 27 such that the plastic particles 88 may further be cooled by the water. It is to be noted that the shield 25 includes an open bottom such that the upper end of the hub 26 will not be blocked by the shield 25 and such that an annular space will be formed between the shield 25 and the hub 26 for allowing the water to flow upward beyond the hub 26 and to flow into the hub 26. The shield 25 is provided for preventing the plastic particles 88 from directly dropping into the hub 26 and for guiding the plastic particles 88 to flow into the water received in the annular chamber 28. The cooled plastic particles 88 that flow through the hose 27 will be dried for further treatments, such as molding processes. It is to be noted that the plastic particles may be quickly cooled down by the water.

Accordingly, the cooling device in accordance with the present invention may be used for quickly cooling the plastic particles.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cooling device for cooling plastic particles, said cooling device comprising:

a casing including an inner and lower portion having a hub secured thereon for defining an annular chamber between said casing and said hub, said hub including an open upper portion and including an outlet, means for supplying water into said annular chamber, said water being allowed to flow into said hub via said open upper portion of said hub and to flow out of said casing via said outlet of said hub, and means for supplying the plastic particles into water received in said annular chamber, said plastic particles being moved upward along said annular chamber by said water and flown out of said hub for allowing said plastic particles to be cooled by said water.

2. The cooling device according to claim 1, wherein said annular chamber includes a bottom portion, water supplying means includes a duct secured to said casing and communicating with said bottom portion of said annular chamber for supplying the water into said annular chamber.

3. The cooling device according to claim 2, wherein said duct is tangent to said casing for generating a helical water flow and for allowing the water to flow upward in said annular chamber in a helical way.

4. The cooling device according to claim 1, wherein said casing includes an upper portion said coupling device further includes a housing secured on said upper portion of said casing, said plastic particles supplying means includes a pipe coupled to said housing for supplying the plastic particles into said housing, said housing includes a bottom portion having a mouth communicating with said annular chamber for allowing the plastic particles to flow into said annular chamber.

5. The cooling device according to claim 4, wherein said housing includes an upper portion having a screen secured thereon for preventing the plastic particles from flowing outward of said housing.

6. The cooling device according to claim 5, wherein said screen includes a center portion having a tube secured thereon for allowing air to quickly flow out of said housing.

7. The cooling device according to claim 4 further comprising means for supporting said housing and said casing on a supporting surface.

8. The cooling device according to claim 4, wherein said housing includes a wavy peripheral wall for allowing the plastic particles to strike onto said wavy peripheral wall and for preventing the plastic particles from sticking together.

9. The cooling device according to claim 1 further comprising means for shielding said hub, the plastic particles being prevented from directly flowing into said hub by said shielding means.

10. The cooling device according to claim 9, wherein said shielding means includes a shield secured in said casing and secured above said hub for preventing the plastic particles from directly flowing into said hub.

* * * * *